US006870325B2

(12) United States Patent
Bushell et al.

(10) Patent No.: US 6,870,325 B2
(45) Date of Patent: Mar. 22, 2005

(54) LED DRIVE CIRCUIT AND METHOD

(75) Inventors: Timothy George Bushell, Cumbria (GB); Michael Christopher Worgan, Cumbria (GB)

(73) Assignee: Oxley Developments Company Limited, Cumbria (GB)

( * ) Notice: Subject to any disclaimer, the term of this patent is extended or adjusted under 35 U.S.C. 154(b) by 0 days.

(21) Appl. No.: 10/371,878

(22) Filed: Feb. 21, 2003

(65) Prior Publication Data

US 2004/0032221 A1 Feb. 19, 2004

(51) Int. Cl.[7] ..... H05B 37/02

(52) U.S. Cl. ..... 315/224; 315/291; 315/307; 315/241 R; 361/93.7; 361/93.8; 361/93.9; 361/101

(58) Field of Search ..... 315/291, 307, 315/224, 225, 227 R, 240, 241 R, 238, 312, 158, 159, 169.3, 169.1; 361/93.7–93.9, 101, 103, 106

(56) References Cited

U.S. PATENT DOCUMENTS

| | | | | |
|---|---|---|---|---|
| 5,625,616 A | | 4/1997 | Koike et al. | |
| 5,694,208 A | * | 12/1997 | Ichikawa | 356/73 |
| 5,783,909 A | * | 7/1998 | Hochstein | 315/159 |
| 5,939,839 A | | 8/1999 | Robel et al. | |
| 6,111,739 A | | 8/2000 | Wu et al. | |
| 6,268,702 B1 | * | 7/2001 | Fleck | 315/185 R |
| 6,285,139 B1 | * | 9/2001 | Ghanem | 315/291 |
| 6,400,101 B1 | | 6/2002 | Biebl et al. | |

FOREIGN PATENT DOCUMENTS

| | | | | |
|---|---|---|---|---|
| EP | 0 516 398 A2 | | 2/1992 | |
| EP | 0 516 398 A3 | | 2/1992 | |
| EP | 0 733 894 A2 | | 9/1996 | |
| FR | 2586844 A1 | * | 3/1987 | G08G/1/095 |
| GB | 2 334 376 A | | 8/1999 | |
| WO | PCT/US98/08432 | | 11/1999 | |
| WO | PCT/CA00/01469 | | 12/2000 | |
| WO | PCT/DE00/00989 | | 1/2001 | |

* cited by examiner

*Primary Examiner*—Haissa Philogene
(74) *Attorney, Agent, or Firm*—Blakely, Sokoloff, Taylor & Zafman; Stephen M. De Klerk

(57) ABSTRACT

An LED drive circuit is disclosed, comprising an electronic controller which is arranged to monitor LED current as a first input. The controller also receives a second input from a sensor associated with the LED. The controller serves to monitor, based on its inputs, at least one further operating parameter of the LED which is either LED junction temperature or LED luminous intensity. The further operating parameter may be directly sensed by the sensor or may be calculated from the inputs to the controller. The controller is adapted to implement a closed loop control on LED current and to thereby limit current as necessary to maintain both the LED current and the further operating parameter below predetermined maximum values.

37 Claims, 1 Drawing Sheet

LED DRIVE CIRCUIT AND METHOD

CROSS-REFERENCE TO OTHER APPLICATIONS

This Application claims priority from United Kingdom Patent Application No. UK 0204212.5, filed on Feb. 22, 2002.

BACKGROUND OF THE INVENTION

1. Field of the Invention

The present invention is concerned with an LED drive circuit and with a method of driving an LED.

2. Discussion of Related Art

The present invention has been developed in response to requirements for aircraft lighting utilising light emitting diodes (LEDs) although it has numerous potential applications in connection with lighting for other purposes. LEDs offer great advantages over more traditional light sources such as filament bulbs. LEDs have a much longer service life than such traditional sources, are more energy efficient and can be chosen to emit only, or largely, in selected frequency ranges. It is known to utilise a bank of LEDs to substitute for a filament bulb eg in traffic lights or in external aircraft lighting. Lamps suitable for such purposes are disclosed, for example, in published French patent application FR2586844 (Sofrela S.A.) and in later British patent GB 2334376 B (L.F.D. limited), both utilising a PCB bearing a bank of LEDs which together provide the luminous intensity required to replace the filament of a traditional bulb.

It is very well known that a circuit for driving an LED should incorporate some means for limiting the current passing through them. The resistance of an LED varies with temperature and if no limit is imposed on the current passing through it, the result can be excessive power being dissipated in the LED with consequent damage to it. The simplest current limiter is a resistor in series with the LED. An alternative is to drive the LED (or LEDs) using a constant current source. The lamp disclosed in GB 2334376B, mentioned above, is believed to operate in this manner.

The present inventor has however recognised that more sophisticated control of the LED is desirable in certain contexts. One reason for this is the change in characteristics of the LED which takes place as it warms up in use. LED lamps driven by conventional circuitry typically become dimmer as this warming takes place and so may be too bright for their function when first switched on or too dim once they have warmed up.

A specific problem of this type is found to occur with aircraft navigation lights. LEDs have been chosen for such lights, among other reasons, because they can be selected and driven to emit very largely at chosen visible frequencies with low emission in the infra red region to which military night vision systems are sensitive. The intention is that while training military personnel in use of night vision systems such aircraft lights can be switched on (to provide the visible beacon required by civil aviation authorities) without causing dazzle (sometimes referred to as "saturation" or "blooming") of the highly sensitive night vision system through excessive infra red emission. Navigation lights must meet statutory requirements, eg laying down a minimum luminosity, at all times, whether they are hot or cold. Using conventional drive technology the result is that a high voltage per LED must be provided to drive the LEDs when they are cold (so that they meet the luminosity requirement) and that as the LEDs warm up they are correspondingly over driven when hot.

European patent application EP0516398 (Mitsubishi Kasei Corporation) discloses a circuit for controlling an LED with the object of providing a highly stable output emission spectrum to serve as a "standard light source". Microprocessor control is used to effect closed loop stabilisation of output wavelength. The approach adopted would not solve the problems to which the present invention is addressed.

SUMMARY OF THE INVENTION

In accordance with the present invention there is an LED drive circuit comprising an electronic controller which is arranged to monitor LED current as a first input and which receives a second input from a sensor associated with the LED, the controller serving to monitor, based on its inputs, at least one further operating parameter of the LED which is either LED junction temperature or LED luminous intensity and being adapted to implement a closed loop control on LED current and to thereby limit current as necessary to maintain both the LED current and the further operating parameter below predetermined maximum values.

Preferably the controller additionally monitors voltage across the LED.

Supply voltage may additionally be monitored by the controller. Supply voltage can be used to signal dimming levels. Measured levels of supply voltage correspond to appropriate max currents.

While the "further operating parameter" could be directly sensed by the sensor (as for example where the sensor is a photo detector arranged to directly sense luminous intensity) but is more typically calculated by the controller based on its inputs and on known physical parameters of the LED arrangement.

The LED can, in accordance with the present invention, be efficiently driven while still being protected from overdriving (and consequent NVG dazzle) and/or damage due to excessive current or heat.

The LED current need not be continually limited by the controller. Preferably the controller serves to limit current only when one of the aforementioned maximum values would otherwise be exceeded, its current limiting function being inactivated at other times.

The sensor is preferably a temperature sensor.

Directly measuring LED junction temperature is difficult. In a preferred embodiment junction temperature is determined by the controller based on the temperature sensor's output, on thermal resistance between the LED junction and the sensor, and on power input to the LED.

In a more sophisticated embodiment allowance is additionally made, in determining LED junction temperature, for the LED's optical output power.

Alternatively junction temperature may be directly sensed.

In a preferred embodiment the controller determines luminous intensity based on LED current and on the temperature sensor's output.

The electronic control may in certain embodiments receive inputs representing further LED parameters.

Preferably the electronic control is a pre-programmed device comprising a microprocessor.

In a particularly preferred embodiment of the present invention the sensor is a temperature sensing resistor arranged in a potential divider to provide a voltage modulated signal to the electronic controller.

In a particularly preferred embodiment, the electronic control limits the LED current when limit values of any of the following parameters would otherwise be exceeded: (1) LED temperature; (2) LED current; (3) luminous intensity.

In a further preferred embodiment of the present invention, the electronic control is arranged to apply a control signal to a transistor connected in series with the LED(s) and thereby to control LED current.

The transistor is preferably a field effect transistor whose gate is connected to the electronic control, the LED(s) being connected in series with the transistor's source/drain path.

In one such embodiment the electronic control serves to emit a pulsed signal which is led to the transistor via smoothing circuitry whereby the transistor receives a DC voltage determined by the electronic control.

The drive circuit is preferably incorporated into an LED light. This may in particular be an external aircraft warning light.

In accordance with a second aspect of the present invention there is a method of driving an LED comprising monitoring LED current and at least one further LED operating parameter which is either LED junction temperature or LED luminous intensity and carrying out closed loop control on LED current thereby to limit current as necessary to maintain both LED current and the further operating parameter below predetermined maximum values.

Preferably the method comprises monitoring both LED junction temperature and LED luminous intensity and maintaining both these parameters below predetermined maximum values by limiting LED current.

It is particularly preferred that the method comprises limiting LED current only when one of the aforementioned maximum values would otherwise be exceeded and allowing LED current to float at other times.

The method preferably comprises calculating (1) Imax (current), a limit to the LED current based on the maximum junction temperature and (2) Imax(intensity), a limit to the LED current based on maximum luminous intensity, selecting the maximum permissible current to be the lowest of Imax(current), Imax(intensity) and the predetermined maximum current and limiting actual LED current only if it would otherwise exceed the maximum permissible current.

In a further preferred embodiment the method comprises measuring a temperature in proximity to the LED junction and determining LED junction temperature based on the measured temperature, on thermal resistance between the LED junction and the sensor, and on power input to the LED In still a further embodiment mode the method comprises measuring a temperature in proximity to the LED junction and determining LED luminous intensity based on the measured temperature and on the LED current.

BRIEF DESCRIPTION OF THE DRAWINGS

Specific embodiments of the present invention will now be described, by way of example only, with reference to the accompanying drawing which is a circuit diagram of an LED drive circuit embodying the invention.

DETAILED DESCRIPTION OF THE INVENTION

Figure 1:
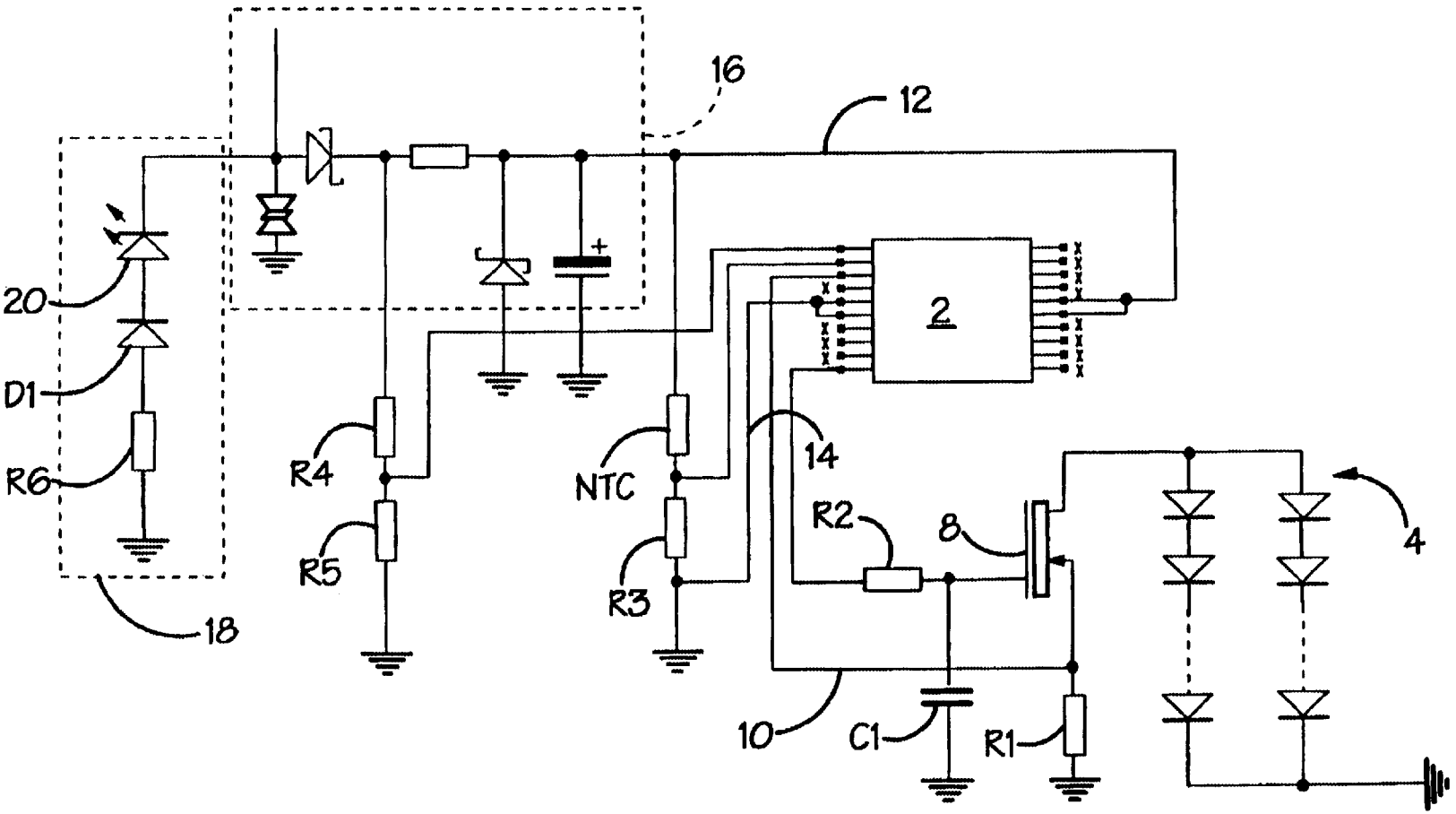

The present invention enables an LED or a bank of LEDs to be controlled in dependence upon measured LED operating parameters. The specific circuit to be described achieves this using a pre-programmed electronic control unit (ECU) 2 which receives the measurements of operating parameters and controls the LED in accordance with a predetermined algorithm. The circuit will be described first of all, followed by the currently preferred algorithm.

In the illustrated circuit supply to a series/parallel array 4 of LEDs is taken from terminal 6 connected to the drain D of a MOSFET 8 whose source is connected via a resistor R1 to ground. Hence the LEDs 4 are connected in series with the MOSFET. The gate of the MOSFET is connected via a resistor R2 to an output of the ECU 2. In addition a smoothing capacitor C1 is connected between the gate and the ECU output. In operation, the ECU's output takes the form of a pulse width modulated (PWM) square wave signal. The smoothing capacitor C1 and associated resistor R2 smooth this signal and thereby provide to the gate of the MOSFET a D.C. voltage. By adjusting the PWM signal the ECU 2 can vary this voltage and in turn the MOSFET, in response to the gate voltage, controls current through the LEDs. The ECU can thus control LED current and it does so in response to inputs from two sources.

The resistor R1 connected in series with the MOSFET, or more specifically between the MOSFET and ground, serves as a current sensing resistor. The potential at the side of this resistor remote from ground is proportional to the current through the LEDs and a line 10 connects this point to an input of the ECU 2.

The second input in this exemplary embodiment of the invention is derived from a temperature sensor NTC connected in a potential divider configuration: one side of the sensor NTC is led to high rail 12 while the other side is led via a resistor R3 to ground. Hence a voltage signal representative of the sensed temperature is applied to an input of the ECU through a line 14 connecting the input to a point between sensor NTC and resistor R3. The ECU also receives a reference voltage, through still a further input, from potential divider R4, R5.

Dotted box 16 in the drawing contains components relating to the smoothing and spike protection of the electrical supply. A further dotted box 18 contains components relating to an optional infra red LED source as will be explained below.

The ECU 2 of the illustrated embodiment is a programmable integrated circuit device of a type well known in itself and provides great flexibility in the control of the LEDs. A control algorithm, implemented by suitable programming of the ECU, will now be described.

In the present embodiment the LED drive current is limited only by the supplied voltage except when this would result in any one of three parameters being exceeded:

1. the maximum LED junction temperature. The LED junction temperature is related to the temperature of the sensor NTC. However the sensor is typically a discrete component, mounted in proximity to the LEDs themselves, so that its temperature will not typically be identical to the junction temperature. Hence allowance is made for thermal resistance of the sensor to the junction
2. the maximum current. Of course LED current is obtained by measurement using the current sensing resistor R1.
3. the maximum luminous intensity. While luminous intensity may in other embodiments of the present invention be directly sensed, in the present embodiment it is calculated based on the sensed current and temperature and known LED characteristics.

While junction temperature, current and luminous intensity are below their respective maxima, current is limited only by supply voltage. The drive circuitry voltage drop is minimised. This allows for the large variation in forward voltage between different batches of LEDs. It also prevents the ECU from "hunting" for an unattainable constant current value which has been found to produce flickering in earlier systems.

For a given lamp, a set of constants is required in order to calculate whether and by how much current should be restricted:

Maximum Junction temperature (° C.)

Maximum Current (mA)

Maximum Luminous Intensity (Cd)

Thermal resistance of Sensor to Junction (° C./W)

Test Temperature (° C.) (LED Junction Temperature during optical testing)

Temperature Coefficient (Relative Intensity/° C.)

Calibration Factor (Cd/mA).

The ECU receives the following measured instantaneous parameters:

| | | |
|---|---|---|
| Sensor Temperature | (° C.) | |
| Array Voltage | (V) | (Voltage across LED array) |
| Current | (mA) | (Total Current through LED array). |

The ECU's calculations involve the following variables:

| | | |
|---|---|---|
| Wmax(temp) | (W) | Maximum power to maintain maximum Junction Temperature. |
| Imax(temp) | (mA) | Maximum Current to maintain maximum Junction Temperature. |
| Imax(current) | (mA) | Maximum Current to maintain maximum Current. |
| Imax(intensity) | (mA) | Maximum Current to maintain maximum intensity. |
| Imax | (mA) | Maximum Current Overall. |
| Watts | (W) | Power input to LED in Watts. |
| Junction Temperature | (° C.) | Junction temperature. |
| Temperature Factor | | Temperature Factor. |

these variables being calculated using the following $$\text{Wmax(temp)} = \frac{(\text{Max Junction Temperature} - \text{Sensor Temperature})}{\text{Thermal Resistance of Sensor to Junction}}$$

Imax(temp) = Wmax(temp)/Array voltage
Imax(current) = Max Current
Watts = (Current * Array voltage)
Junction Temperature = Sensor Temperature + (Resistance sensor to junction × Watts)
Temperature Factor = 1 + [(junction Temperature − Test Temperature) × Temp Coefficient]
Imax(intensity) = Max Intensity/(Temperature Factor * Calibration Factor)
Imax = Imax(temp) OR Imax(current) OR Imax(intensity) Whichever is smaller
and the condition for current adjustment is
IF Current >= Imax THEN (Adjust Current and maintain it at Imax)
ELSE (Allow Current to float i.e. turn off active control)

Hence by virtue of the present invention the LEDs can be driven by a circuit having in itself minimal voltage drop while current restriction is not required, with consequent high efficiency. Over driving of the LEDs, as discussed above, can be avoided by virtue of the limit imposed on current aid junction temperature. In other embodiments allowance could be made eg for controlled adjustment of the intensity.

The circuit operates in a form of feedback loop. Adjustments to LED current alter the measured parameters in a manner which is detected by the ECU 2 and hence affects subsequent current adjustments. The actual adjustment of LED current is controlled by adaptive PID (proportional integral differential) algorithm. Such techniques are in themselves well known and will not be escribed in detail herein.

Reference has been made above to an optional infra red light source whose components are shown in dotted box 18 of the drawing. This comprises an LED 20 whose emission is in the infra red part of the spectrum, connected via a current limiting restrictor R6 and a reverse voltage blocking diode D1 to ground and on its other side to the supply rail. The infra red LED is actuated by reversing polarity of the supply rail, which at the same time cuts off supply to the ECU 2 and visible LEDs 4. Hence the circuit can emit either infra red or visible light, which is appropriate in aircraft lights operable in a visible or a "covert" (IR only) mode.

The circuit is well suited to incorporation in aircraft lighting such as navigation lights.

What is claimed is:

1. An LED drive circuit comprising an electronic controller which is arranged to monitor LED current as a first input an which receives a second input from a sensor associated with the LED, the controller serving to monitor, based on its inputs, both LED junction temperature and LED emitted light intensity and being adapted to implement a closed loop control on LED current and to thereby limit current as necessary to maintain both the LED current and the LED emitted light intensity below predetermined maximum values.

2. An LED drive circuit as claimed in claim 1 comprising a plurality of LEDs.

3. An LED drive circuit as claimed in claim 1 wherein the controller serves to limit current only when one of the aforementioned maximum values would otherwise be exceeded, the controller's current limiting function being inactivated at other times.

4. An LED drive circuit as claimed in claim 1 wherein the sensor is a temperature sensor.

5. An LED drive circuit as claimed in claim 4 wherein the sensor is arranged in proximity to the LED junction and junction temperature is determined by the controller based on the temperature sensor's output on thermal resistance between the LED junction and the sensor, and on power input to the LED.

6. An LED drive circuit as claimed in claim 4 wherein the controller determines emitted light intensity based on LED current and on the temperature sensor's output.

7. An LED drive circuit as claimed in claim 1 wherein the electronic controller is a pre-programmed device comprising a microprocessor.

8. An LED drive circuit as claimed in claim 4 wherein the temperature sensor is a temperature sensing resistor arranged in a potential divider to provide a voltage modulated signal to the electronic controller.

9. An LED drive circuit as claimed in claim 1 further comprising a transistor connected in series with the LED, the electronic controller being connected to apply a control signal to the transistor and thereby to control LED current.

10. An LED drive circuit as claimed in claim 9 wherein the transistor is a field effect transistor whose gate is connected to the electronic controller, the LED being connected in series with the LED's source/drain path.

11. An LED drive circuit as claimed in claim 9 wherein the electronic controller serves to emit a pulsed signal which is led to the transistor via smoothing circuitry whereby the transistor receives a DC voltage determined by the electronic controller.

12. An LED drive circuit as claimed in claim 2 wherein the LEDs are arranged in an array.

13. An LED drive circuit comprising an electronic controller which is arranged to monitor LED current as a first input and which receives a second input from a temperature sensing resistor associated with the LED, the temperature sensing resistor arranged in a potential divider to provide a voltage modulated temperature signal to the electronic controller, and the electronic controller serving to monitor based on its inputs, at least one further operating parameter of the LED which is one of LED junction temperature and LED luminous intensity and being adapted to implement a closed loop control on LED current and to thereby limit current as necessary to maintain both the LED current and the further operating parameter below predetermined maximum values, control over LED current being made through a transistor connected in series with the LED, the electronic controller serving to emit a pulsed control signal which is led to the transistor via smoothing circuitry so that the transistor receives a DC voltage determined by the electronic controller.

14. An LED light comprising a drive circuit comprising an electronic controller which is arranged to monitor LED current as a first input and which receives a second input from a sensor associated with the LED, the controller serving to monitor, based on its inputs, both LED junction temperature and LED emitted light intensity and being adapted to implement closed loop control on LED current and to thereby limit current as necessary to maintain both the LED current and the LED emitted light intensity below predetermined maximum values.

15. An LED light as claimed in claim 14 which is an external aircraft warning light.

16. A method of driving an LED comprising monitoring LED current, LED junction temperature and LED emitted light intensity and carrying out closed loop control on LED current thereby to limit current as necessary to maintain LED current, LED junction temperature and LED emitted light intensity below predetermined maximum values.

17. A method as claimed in claim 16 comprising measuring a temperature in proximity to the LED junction and determining LED luminous intensity based on the measured temperature and on the LED current.

18. A method as claimed in claim 16 comprising limiting LED current only when one of the aforementioned maximum values would otherwise be exceeded and allowing LED current to float at other times.

19. A method as claimed in claim 16 comprising calculating (1) Imax(current), a limit to the LED current based on the maximum junction temperature and (2) Imax(intensity), a limit to the LED current based on maximum luminous intensity, selecting the maximum permissible current to be the lowest of Imax(current), Imax(intensity) and the predetermined maximum current and limiting actual LED current only if it would otherwise exceed the maximum permissible current.

20. A method as claimed in claim 16 comprising measuring a temperature in proximity to the LED junction and determining LED junction temperature based on the measured temperature, on thermal resistance between the LED junction and the sensor, and on power input to the LED.

21. An LED drive circuit comprising an electronic controller which is arranged to monitor LED current as a first input and which receives a second input from a sensor associated with the LED, the controller serving to monitor, based on its inputs, at least one further operating parameter of the LED which is one of LED junction temperature and LED luminous intensity and being adapted to implement a closed loop control on LED current and to thereby limit current as necessary to maintain both the LED current and the further operating parameter below predetermined maximum values, wherein the controller serves to limit current only when one of the aforementioned maximum value would otherwise be exceeded, the controller's current limiting function being inactivated at other times.

22. An LED drive circuit as claimed in claim 21 wherein the sensor is a temperature sensor.

23. An LED drive circuit as claimed in claim 22 wherein the controller determines luminous intensity based on LED current and on the temperature sensor's output.

24. An LED drive circuit comprising an electronic controller which is arranged to monitor LED current as a first input and which receives a second input from a temperature sensor arranged in proximity to the LED junction, the controller serving to determine LED junction temperature based on the temperature sensor's output, on thermal resistance between the LED junction and the sensor, and on power input to the LED, and being adapted to implement a closed loop control on LED current and to thereby limit current as necessary to maintain both the LED current and the junction temperature below predetermined maximum values.

25. An LED drive circuit as claimed in claim 24 wherein the electronic controller additionally determines LED emitted light intensity based on LED current and on the temperature sensor's output and controls LED current to maintain LED emitted light intensity below a predetermined maxim value.

26. An LED drive circuit as claimed in claim 24 wherein the controller serves to limit current only when one of the aforementioned maximum values would otherwise be exceeded, the controller's current limiting function being inactivated at other times.

27. An LED drive circuit comprising an electronic controller which is arranged to monitor LED current as a first input and which receives a second input from a temperature sensing resistor associated with the LED, the temperature sensing resistor arranged in a potential divider to provide a voltage modulated temperature signal to the electronic controller, and the electronic controller serving to monitor based on its inputs, at least one further operating parameter of the LED which is one of LED junction temperature and LED luminous intensity and being adapted to implement a closed loop control on LED current and to thereby limit current as necessary to maintain both the LED current and the further operating parameter below predetermined maximum values.

28. An LED drive circuit as claimed in claim 27 wherein the temperature sensing resistor is arranged in proximity to the LED and junction temperature is determined by the controller based on the temperature sensor's output, on thermal resistance between the LED junction and the sensor, and on power input to the LED.

29. An LED drive circuit as claimed in claim 27 wherein the electronic controller is arranged to monitor both LED junction temperature and LED emitted light intensity and to maintain both these parameters below predetermined maximum values by limiting LED current.

30. An LED drive circuit as claimed in claim wherein the controller serves to limit current only when one of the aforementioned maximum values would otherwise be exceeded, the controller's current limiting function being inactivated at other times.

31. A method of driving an LED comprising monitoring LED current and measuring temperature in proximity to the LED junction, determining LED emitted light intensity based on the measured temperature and on the LED current, and carrying out closed loop control on LED current thereby to limit current as necessary to maintain both LED current and LED emitted light intensity below predetermined maximum values.

32. A method as claimed in claim 31 comprising limiting current only when one or both of LED emitted light intensity and LED current would otherwise exceed the aforementioned maximum values and allowing LED current to float at other times.

33. A method of driving an LED comprising monitoring LED current and at least one further LED operating parameter which is one of LED function temperature and LED luminous intensity and carrying out closed loop control on LED current thereby to limit current as necessary to maintain both LED current and the further operating parameter below predetermined maximum values, wherein LED current is limited only when one of the aforementioned maximum values would otherwise be exceeded, LED current being allowed to float at other times.

34. A method as claimed in claim 33 comprising calculating (1) Imax(current), a limit to the LED current based on the maximum junction temperature and (2) Imax(intensity), a limit to the LED current based on maximum luminous intensity, selecting the maximum permissible current and limiting actual LED current only if it would otherwise exceed the maximum permissible current.

35. A method of driving an LED comprising monitoring LED current and measuring a temperature in proximity to the LED junction using a sensor, determining LED junction temperature based on the measured temperature, on thermal resistance between the LED junction and the sensor, and on power input to the LED, and carrying out closed loop control on LED current thereby to limit current as necessary to maintain both LED current and junction temperature below predetermined maximum values.

36. A method as claimed in claim 35 comprising monitoring LED emitted light intensity in addition to LED junction temperature and maintaining both these parameters below predetermined maximum values by limiting LED current.

37. A method as claimed in claim 36 comprising limiting LED current only when one of the aforementioned maximum values would otherwise be exceeded and allowing LED current to float at other times.

* * * * *

UNITED STATES PATENT AND TRADEMARK OFFICE

CERTIFICATE OF CORRECTION

PATENT NO. : 6,870,325 B2
APPLICATION NO. : 10/371878
DATED : March 22, 2005
INVENTOR(S) : Timothy George Bushell It is certified that error appears in the above-identified patent and that said Letters Patent is hereby corrected as shown below:

On The Title Page:

In Item [30], Foreign Application Priority Data, please add:

--Feb. 22, 2002 (GB).....0204212.5--

Signed and Sealed this

Twenty-ninth Day of May, 2007

JON W. DUDAS
*Director of the United States Patent and Trademark Office*